US007303447B1

(12) United States Patent
Tyler

(10) Patent No.: US 7,303,447 B1
(45) Date of Patent: Dec. 4, 2007

(54) ELECTRICAL TERMINAL WITH ANTI-SNAG FEATURE

(75) Inventor: Adam P. Tyler, Rochester Hills, MI (US)

(73) Assignee: FCI Americas Technology, Inc., Reno, NV (US)

( * ) Notice: Subject to any disclaimer, the term of this patent is extended or adjusted under 35 U.S.C. 154(b) by 44 days.

(21) Appl. No.: 11/498,359

(22) Filed: Aug. 2, 2006

Related U.S. Application Data

(63) Continuation-in-part of application No. 11/395,694, filed on Mar. 31, 2006.

(51) Int. Cl.
*H01R 13/432* (2006.01)

(52) U.S. Cl. ..... 439/748; 439/746; 439/851

(58) Field of Classification Search ..... 439/748, 439/595, 749, 746, 852, 851, 745
See application file for complete search history.

(56) References Cited

U.S. PATENT DOCUMENTS

| | | | | |
|---|---|---|---|---|
| 3,058,091 | A | 10/1962 | Henschen | 339/217 |
| 4,781,628 | A | 11/1988 | Detter et al. | 439/748 |
| 5,489,223 | A * | 2/1996 | Faje et al. | 439/748 |
| 5,601,458 | A | 2/1997 | Ohsumi et al. | 439/852 |
| 5,800,220 | A * | 9/1998 | Feeny et al. | 439/849 |
| 6,056,604 | A | 5/2000 | Roy et al. | 439/845 |
| 6,106,339 | A * | 8/2000 | Nagai | 439/748 |
| 6,247,975 | B1 | 6/2001 | Cue | 439/845 |
| 6,520,801 | B2 | 2/2003 | Tabata et al. | 439/595 |
| 6,527,601 | B2 * | 3/2003 | Chen | 439/852 |
| 6,655,997 | B2 * | 12/2003 | Lam et al. | 439/746 |
| 6,729,904 | B2 | 5/2004 | Naukou et al. | 439/595 |
| 6,767,259 | B2 | 7/2004 | Kojima et al. | 439/752 |
| 6,796,836 | B2 | 9/2004 | Ichida et al. | 439/595 |
| 6,796,837 | B2 | 9/2004 | Fukatsu et al. | 439/595 |
| 6,796,845 | B2 | 9/2004 | Kuiken et al. | 439/668 |
| 2005/0215106 | A1 * | 9/2005 | Holub | 439/357 |

* cited by examiner

*Primary Examiner*—Renee Luebke
*Assistant Examiner*—Harshad C Patel
(74) *Attorney, Agent, or Firm*—Harrington & Smith, PC

(57) ABSTRACT

An electrical connector including a housing comprising at least two contact receiving areas and at least two contact terminals connected to the housing in the contact receiving areas. A first one of the contact terminals includes a combined housing latch and shorting member. The combined housing latch and shorting member is latched behind a portion of the housing to retain the first contact terminal to the housing. The combined housing latch and shorting member directly electrically contacts a second one of the contact terminals. The combined housing latch and shorting member is resiliently deflectable and adapted to be moved by a portion of a mating electrical connector to electrically disconnect from the second contact terminal and still be retained latched behind the portion of the housing.

20 Claims, 14 Drawing Sheets

ELECTRICAL TERMINAL WITH ANTI-SNAG FEATURE

CROSS REFERENCE TO RELATED APPLICATION

This is a continuation-in-part patent application of U.S. patent application Ser. No. 11/395,694 filed Mar. 31, 2006, which is hereby incorporated by reference in its entirety.

BACKGROUND OF THE INVENTION

1. Field of the Invention

The present invention relates to an electrical terminal and, more particularly, to an electrical terminal having an anti-snag feature.

2. Brief Description of Prior Developments

U.S. Pat. Nos. 6,247,975 and 6,056,604, which are hereby incorporated by reference in their entireties, disclose multi-piece electrical receptacle terminals. Springs are provided to mechanically and electrically connect a male contact or blade terminal from a mating electrical connector in the receptacle terminals. These types of terminals are used in electrical connector housings which have plastic connector primary lock fingers to lock the terminals inside the housings. However, terminals with primary lock tangs are more space efficient than terminals that require housings with plastic connector primary lock fingers.

A problem exists with terminals that have primary lock tangs in that they typically cannot pass through a mat wire seal of the electrical connector without cutting or tearing the seal. There is a desire to provide an anti-snag feature in a terminal with a primary lock tang that will allow the terminal to be installed and removed through a mat seal without cutting or tearing, and will also not interfere with the primary lock function of the tang.

SUMMARY OF THE INVENTION

In accordance with one aspect of the present invention, an electrical connector is provided including a housing comprising at least two contact receiving areas and at least two contact terminals connected to the housing in the contact receiving areas. A first one of the contact terminals includes a combined housing latch and shorting member. The combined housing latch and shorting member is latched behind a portion of the housing to retain the first contact terminal to the housing. The combined housing latch and shorting member directly electrically contacts a second one of the contact terminals. The combined housing latch and shorting member is resiliently deflectable and adapted to be moved by a portion of a mating electrical connector to electrically disconnect from the second contact terminal and still be retained latched behind the portion of the housing.

In accordance with another aspect of the invention, an electrical terminal is provided comprising a conductor connection section; a mating terminal connection section connected to the conductor connection section; a deflectable latch proximate the mating terminal connection section; and a deflectable anti-snag ramp located generally behind the deflectable latch. The electrical terminal is a two-piece terminal comprising a first piece forming the conductor connection section and the mating terminal connection section, and a second piece connected over the mating terminal connection section comprising the deflectable latch and the deflectable anti-snag ramp.

In accordance with another aspect of the invention, a method of forming an electrical contact terminal is provided comprising forming a conductor connection section; forming a mating terminal connection section connected to the conductor connection section, wherein the mating terminal connection section comprises deflectable contact arms forming a female receiving area; forming a deflectable latch proximate the mating terminal connection section; and forming a deflectable anti-snag ramp located generally behind the deflectable latch. The electrical contact terminal is a two-piece terminal comprising a first piece forming the conductor connection section and the mating terminal connection section, and a second piece connected to the first piece over the mating terminal connection section. The second piece comprises the deflectable latch and the deflectable anti-snag ramp.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
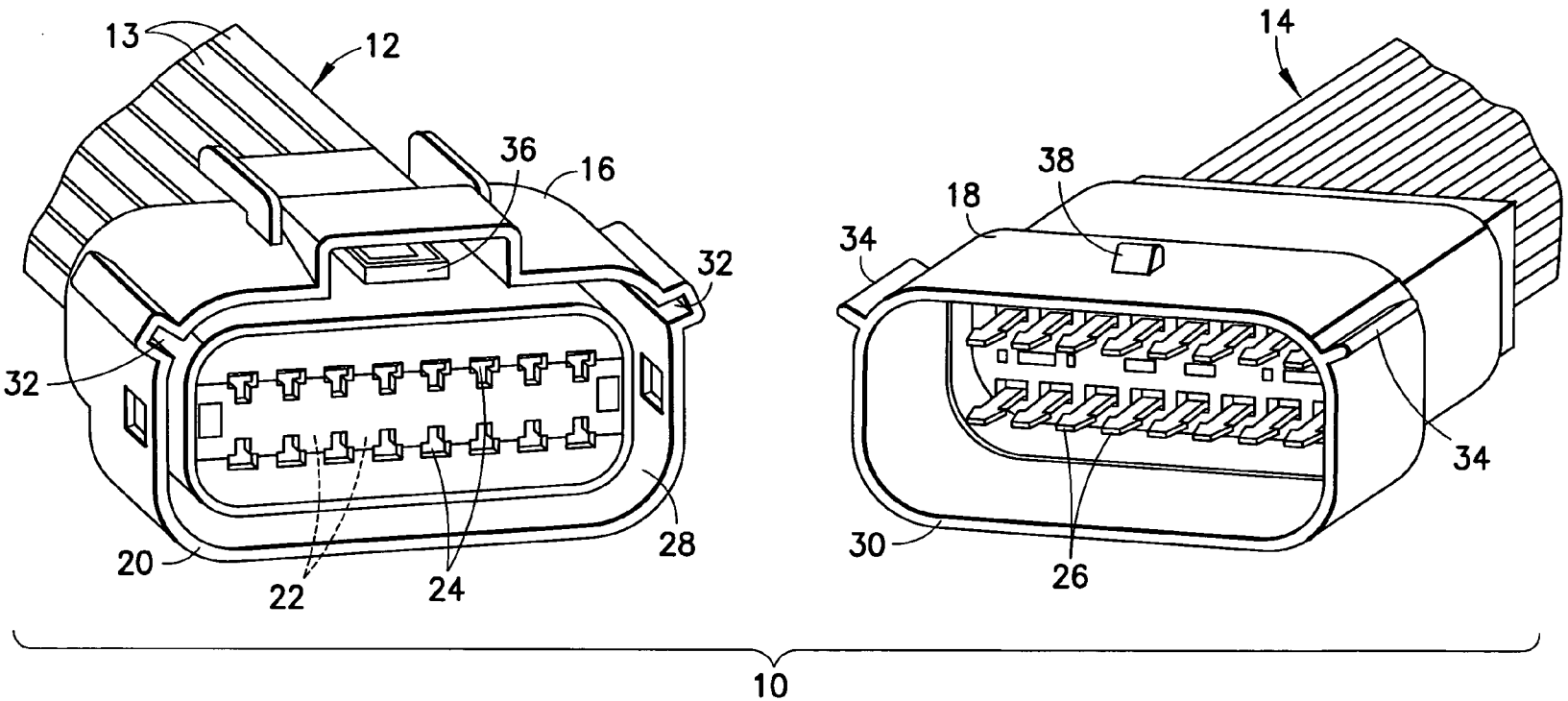
FIG. 1 is an exploded perspective view of an electrical connection system.

Referring to FIG. 1, there is shown an exploded perspective view of an electrical connection system 10 for electrically connecting two groups 12, 14 of electrical conductors to each other. The electrical connection system 10 comprises a first electrical connector 16 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The first electrical connector 16 is connected to the first group 12 of electrical conductors 13. The mating second electrical connector 18 is connected to the second group 14 of electrical conductors. The first electrical connector 16 comprises a housing 20 and electrical contacts 22 located inside the housing 20. The housing 20 has receiving areas 24 in its front face for receiving male contacts 26 of the second electrical connector 18. The housing 20 also comprises the receiving area 28 for receiving the front end of the housing 30 of the second electrical connector 18. The receiving area 28 comprises slots 32 for receiving polarizing ribs 34 of the second electrical connector 18. The housing 20 also comprises a latch 36 which extends into the receiving area 28. The latch 36 is adapted to snap lock latch with the latch protrusion 38 of the housing 30 of the second electrical connector 18.

Figure 2:
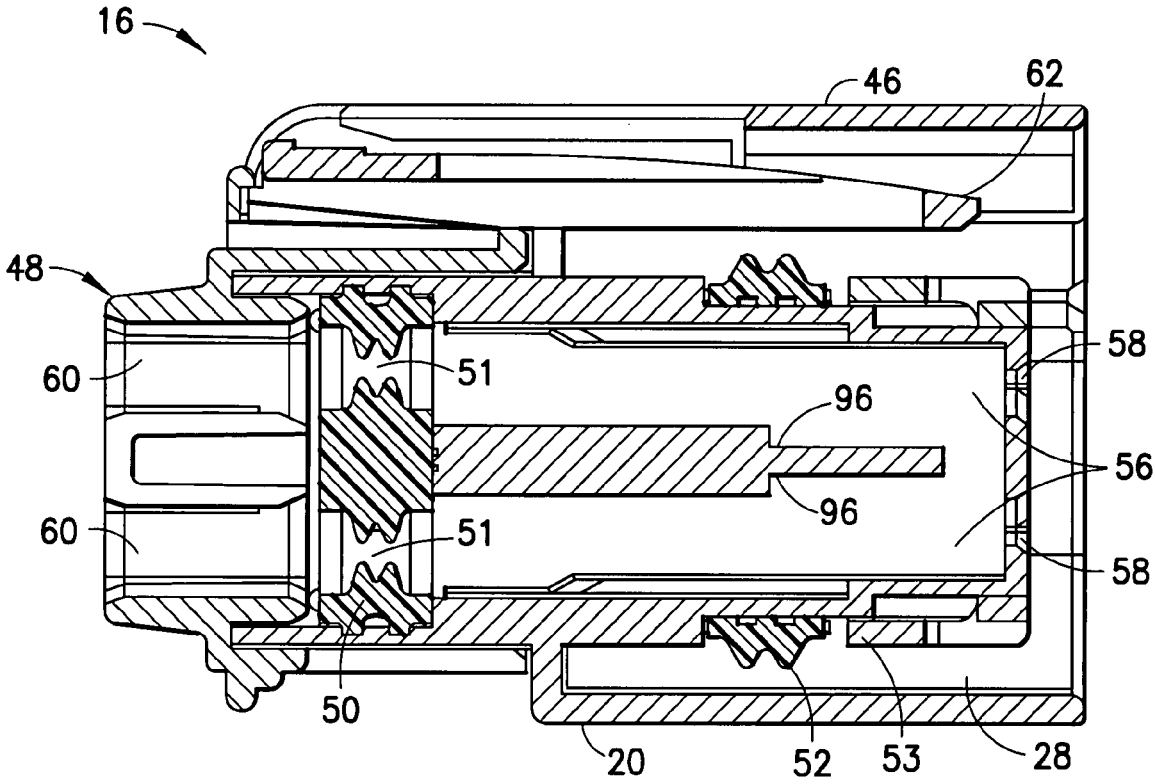
FIG. 2 is a cross sectional view of one of the electrical connectors shown in FIG. 1, but without showing the terminals.
Figure 3:
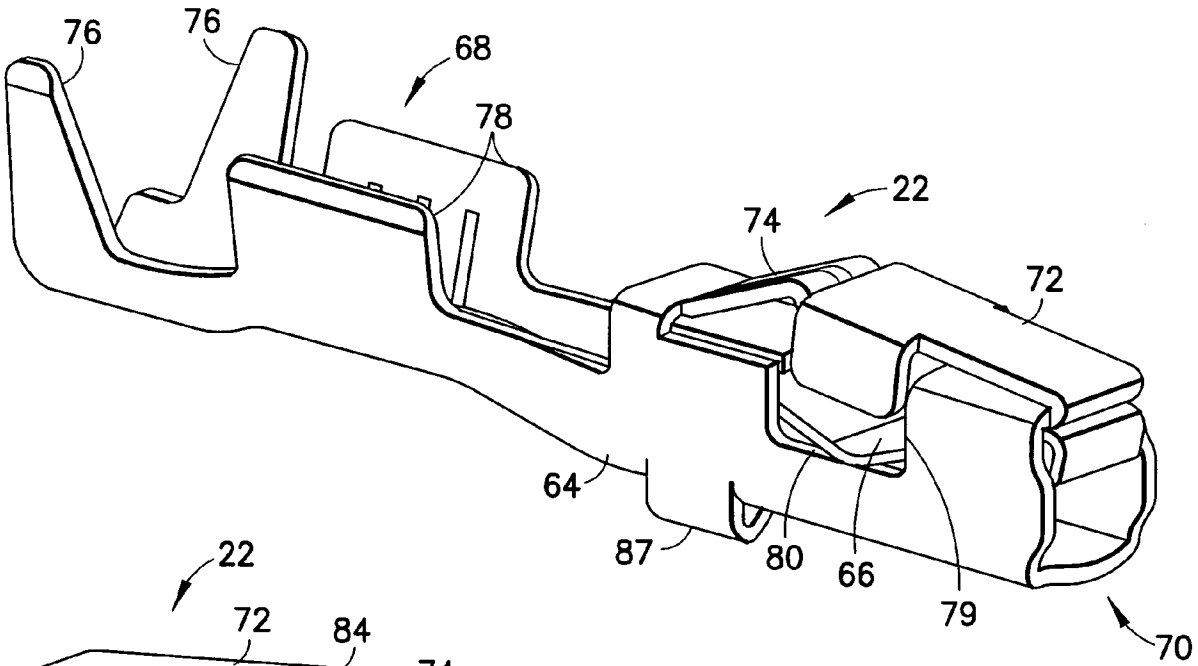
FIG. 3 is a perspective view of one of the terminals used in the connector shown in FIG. 2.
Figure 4:
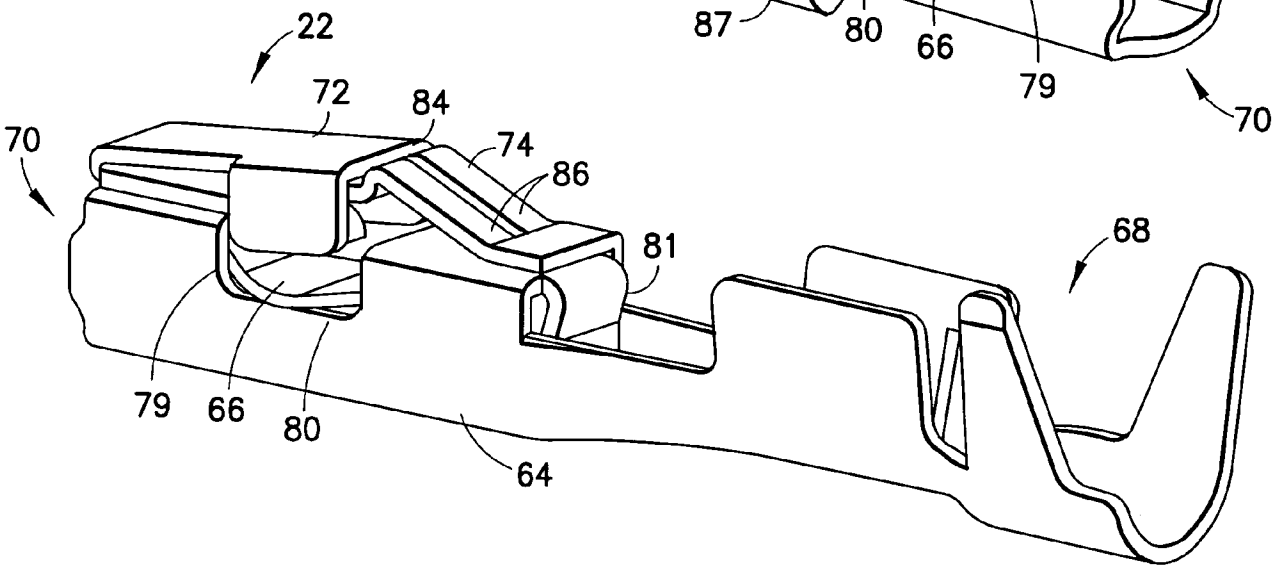
FIG. 4 is a perspective view of the terminals shown in FIG. 3 from another direction.

Referring also to FIG. 2, a cross sectional view of the first electrical connector 16 is shown, but without the electrical terminals 22 and the electrical conductors 13 merely for the sake of clarity. FIGS. 3 and 4 show perspective views of one of the terminals 22. The electrical connector 16 comprises a housing 20.

The housing 20 comprises a main housing member 46 and a seal retainer 48. The seal retainer 48 is fixedly connected to the rear end of the main housing member 46, such as by a snap lock connection, to capture a mat wire seal 50 between the seal retainer 48 and the main housing member 46. The seal 50 is preferably a flexible, resiliently deformable rubber or polymer member which provides a seal with the electrical conductors 13. The seal has multiple holes 51 for individual ones of the conductors 13 to pass through. The electrical connector 16 also comprises a second seal 52 adapted to engage the housing 30 of the second electrical conductor 18 in the receiving area 28 of the main housing member 46. A front seal retainer 53 is attached to the front of the main housing member 46 to retain the front seal 52 on the main housing member 46.

The main housing member 46 comprises contact receiving areas 56. The electrical contacts 22 are located in the contact receiving areas 56. The front end of the main housing member 46 comprises apertures 58 into the contact receiving areas 56. The apertures 58 are adapted to allow insertion of the male contacts 26 into the contact receiving areas 56 and into mating electrical connection with the electrical contacts 22. The electrical conductors 13 are adapted to extend through apertures 60 of the seal retainer 48 and into the contact receiving areas 56 where they are connected to the electrical contacts 22. The seal 50 is adapted to seal the rear end of the contact receiving areas 56 at the rear end of the main housing member 46 where the electrical conductors 13 pass into the rear end of the main housing member 46.

The main housing member 46 comprises a mating electrical connector latch 62. When the electrical connector 16 is connected to the second electrical connector 18, the latch 62 is adapted to removably latch with the latch protrusion 38 of the second electrical connector 18. The latch 62 is described in U.S. patent application Ser. No. 10/806,731 which is hereby incorporated by reference in its entirety. However, in alternate embodiments any suitable mating connector latching system could be provided.

Figure 5:
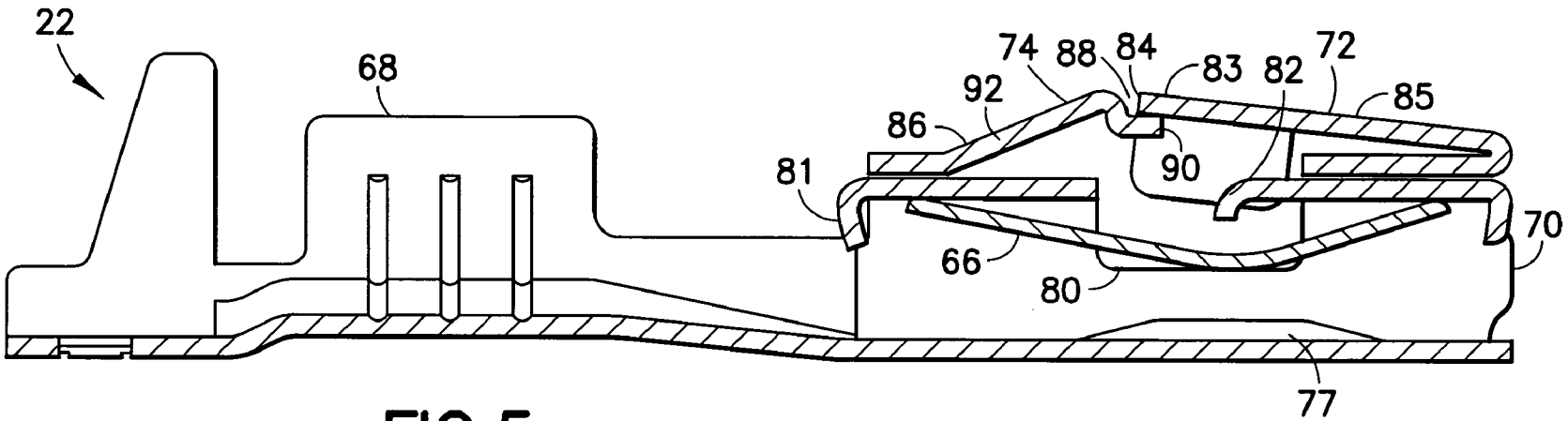
FIG. 5 is a cross sectional view of the terminal shown in FIGS. 3-4.

The electrical terminals or contacts 22 comprise contacts which are coupled to the electrical conductors 13 in the first group 12 of electrical conductors. The electrical contacts 22 comprise female contact sections adapted to receive the male contacts 26 of the second electrical connector 18. Referring to FIGS. 3-5, the electrical terminals 22 generally comprise a main member or frame 64 and a spring member 66. The main member 64 is a one piece metal member which is cut and formed into the shape shown. The main member 64 comprises a conductor connection section 68, a mating terminal connection section 70, a latch 72 and an anti-snag feature 74. The conductor connection section 68 is for connecting the terminal 22 to one of the wires 13. The conductor connection section 68 comprises insulation grip members 76 and conductor grip members 78. However, in alternate embodiments any suitable configuration for attaching the terminal 22 to one of the wires 13 could be provided.

The mating terminal connection section 70 has the spring member 66 connected inside of it. The mating terminal connection section 70 forms a female connection section which is adapted to receive one of the contacts 26 of the mating connector 18 and clamp the contact 26 between the spring contact member 66 and the fixed contact surface 77. The terminal connection section 70 has a general box shape with side holes 79 which form shelves 80 for movably capturing lateral sides the spring contact member 66. A top side also has a downward projection 82 which forms an overstress protection feature for the spring contact member 66. A secondary lock surface 81 is also provided at the rear of the female connection section. An orientation feature 87 is also provided on the terminal for orientating the terminal in the housing 20. In alternate embodiments any suitably shaped mating terminal connection section, including perhaps a male connection section.

The latch 72 is a flexible primary lock for latching the terminal 22 with the housing 20 inside one of the contact receiving areas 56. The latch 72 extends rearward from the front end of the mating terminal connection section 70 as a general resiliently deflectable cantilevered arm. The end 83 of the arm forms a latching surface 84 to snap-lock latch with a portion of the housing 20. The top side of the latch 72 forms a forward facing ramp surface 85.

The anti-snag feature 74 comprises two resiliently deflectable cantilevered arms 86 which extend forward from a rear end of the mating terminal connection section 70. The front end of the arms 86 have pocket areas 88 which receive the end 83 of the latch 72. Distal tips 90 of the arms 86 are located beneath the end 83 of the latch 72. However, in an alternate embodiment the distal tip of the arms might not be provided beneath the latch 72. A top side of the arms 86 extend above the top side of the surface 84 when the arms 86 are not deflected. Alternatively, the top sides of the arms 86 could be at the same height as the top of the surface 84 when the arms 86 are not deflected. The top sides of the arms 86 form rearward facing ramp surfaces 92.

Figure 6:
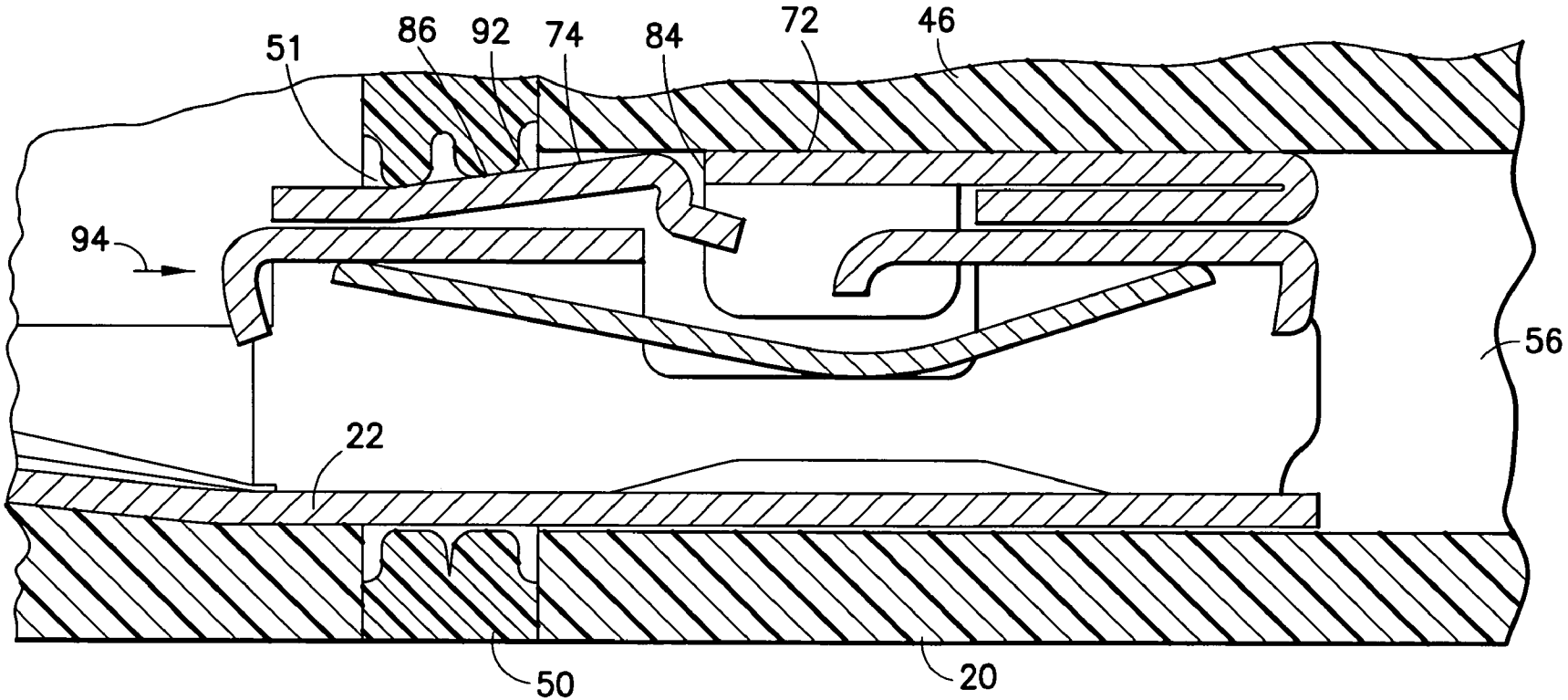
FIG. 6 is a partial cross sectional view showing insertion of one of the terminals into the housing.

Referring also to FIG. 6, one of the terminals 22 is shown being inserted through the rear end of the connector housing 20 into one of the contact receiving areas 56 as indicated by arrow 94. The main housing member 46 causes the latch 72 to deflect inward. The anti-snag feature 74 is also deflected inward; first by contact with the end 83 of the latch 72 and then by direct contact with the main housing member 46. The seal 50 is resiliently deformed during this insertion of the terminal into the connector housing with the ramp surface 85 helping to prevent snagging of the anti-snag feature 74 on the seal 50 during insertion.

Figure 7:
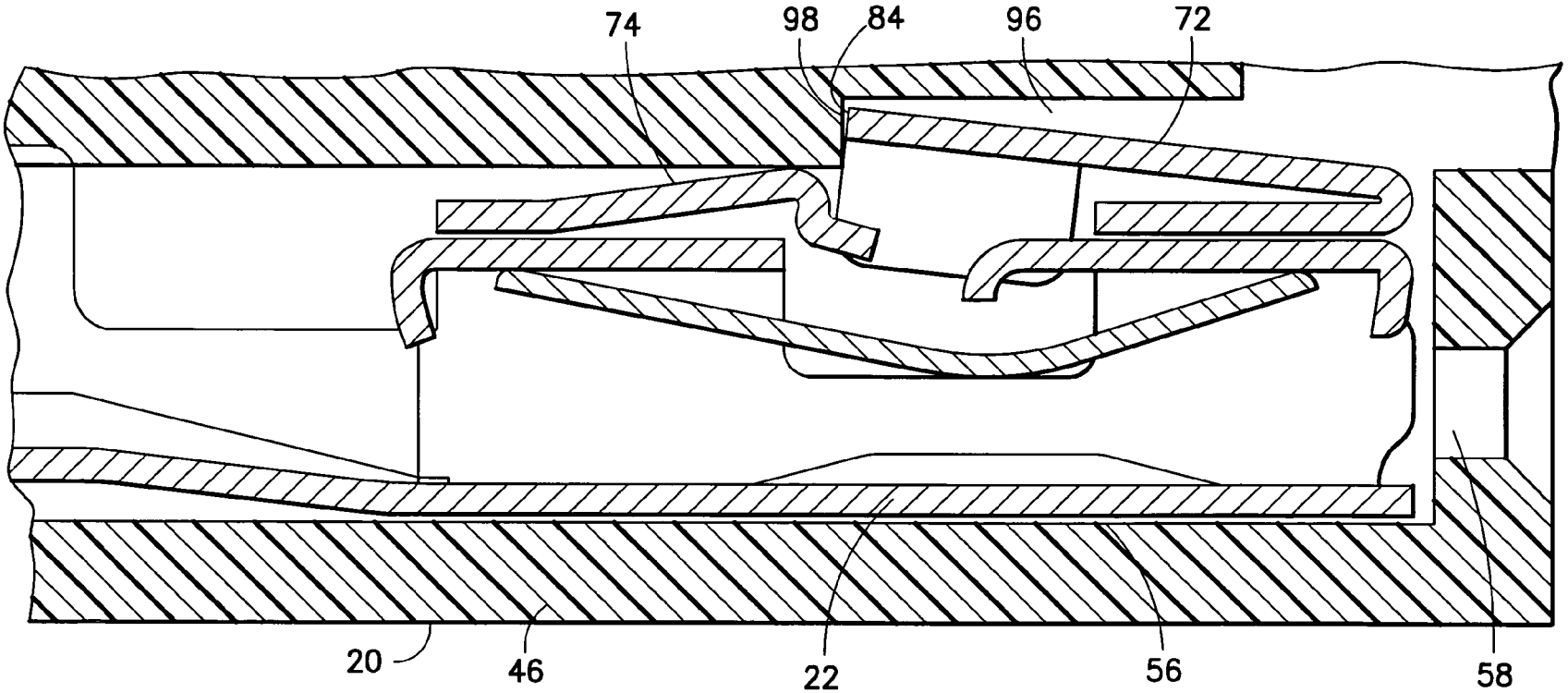
FIG. 7 is a partial cross sectional view showing one of the terminals in a fully inserted position in the housing.

Referring also to FIG. 7, with further insertion of the terminal 22 into the housing, the terminal reaches its fully inserted position inside the receiving area 56. The main housing member 46 has a snap-lock recess 96 for each contact receiving area 56. When the terminal reaches its fully inserted position, the latch 72 can deflect back to its outward position. This results in the surface 84 being located in the recess 96 in front of the latching surface or shelf 98. The primary lock provided by the latch 72 snaps over the shelf in the connector cavity, thus, providing retention while the snag-resistant feature remains deflected. The two surfaces 84, 98 cooperate to prevent unintentional withdrawal of the terminal from the receiving area 56 reverse to direction 94. The anti-snag feature 74 can remain deflected inward at the fully inserted position. Thus, the anti-snag feature does not interfere with the operation of the latch 72.

Figure 8:
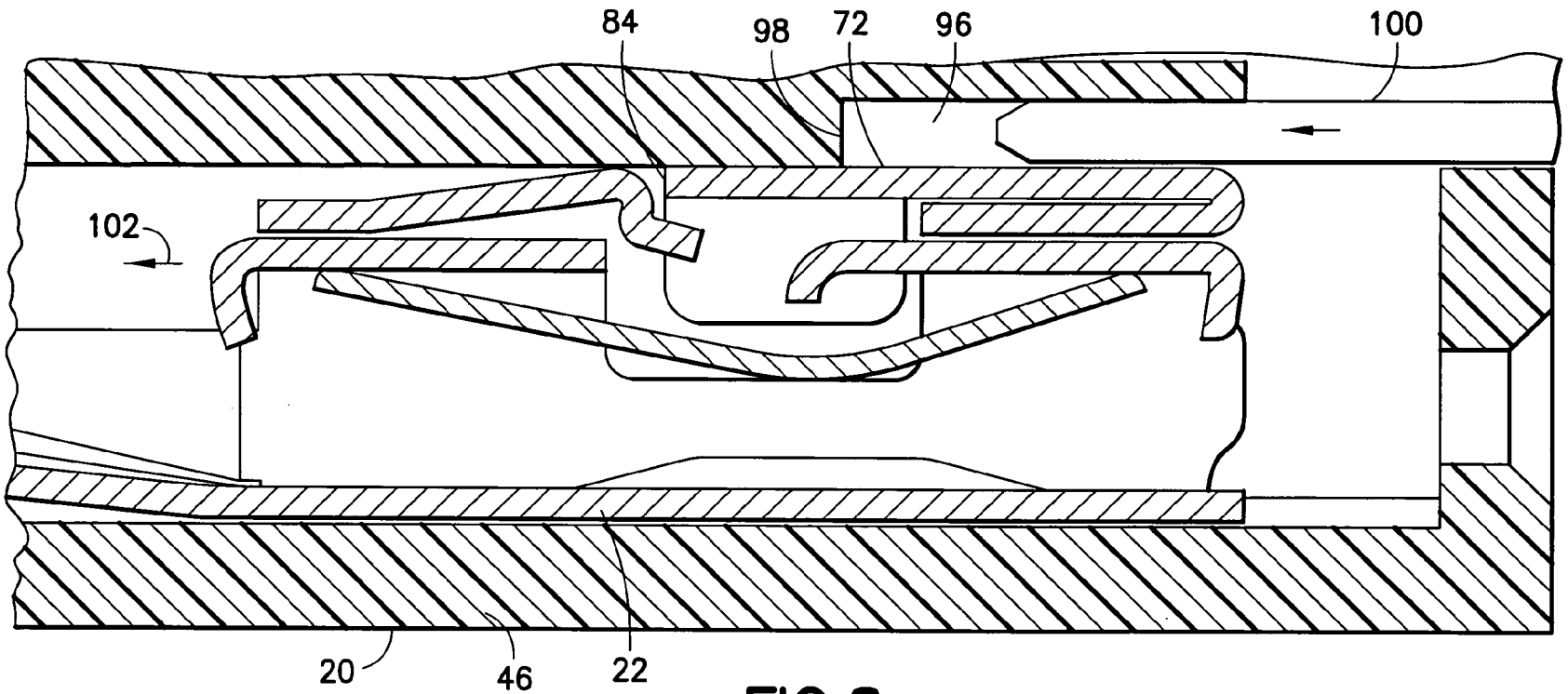
FIG. 8 is a partial cross sectional view showing removal of one of the terminals from the housing.

Referring also to FIG. 8, the terminal 22 can be removed from the housing 20 with the aid of a servicing tool 100. The tool 100 can be inserted through the front of the housing 20 into the recess 96. The front of the tool 100 contacts the ramp surface 85 of the latch 72 and deflects the latch inward. This moves the latch surfaces 84, 98 apart to allow the terminal 22 to be pulled rearward as indicated by arrow 102. Referring back to FIG. 6, as the terminal 22 is pulled rearward the ramp surface 92 on the arms 86 can resiliently deform the seal 50 and prevent the latching surface 84 from snagging on the seal 50. This prevents the latching surface 84 from cutting or tearing the seal 50 as the terminal 22 is being withdrawn through the seal 50.

With the invention, the primary lock 72 and the anti-snag lock 74 can be separate and flexible. When the contact 22 is inserted in the housing 20 through the mat seal, the primary lock 72 and the anti-snag lock 74 are pressed down. Once the primary lock 74 clears the inner wall of the housing cavity, it snaps upward adjacent to a shelf to prevent the contact terminal from being pulled backward out of the housing. The flexible lock beams or arms 86 are located on the terminal, and have free ends that extend in a direction opposite to the direction of insertion into the housing cavity. In an alternate embodiment, more or less than two arms 86 could be provided. In another alternate embodiment, the spring contact member 66 could be formed from the terminal body 64 (i.e., integral with the terminal body) rather than a separate member captured inside the terminal body as shown in the drawings.

Figure 9:
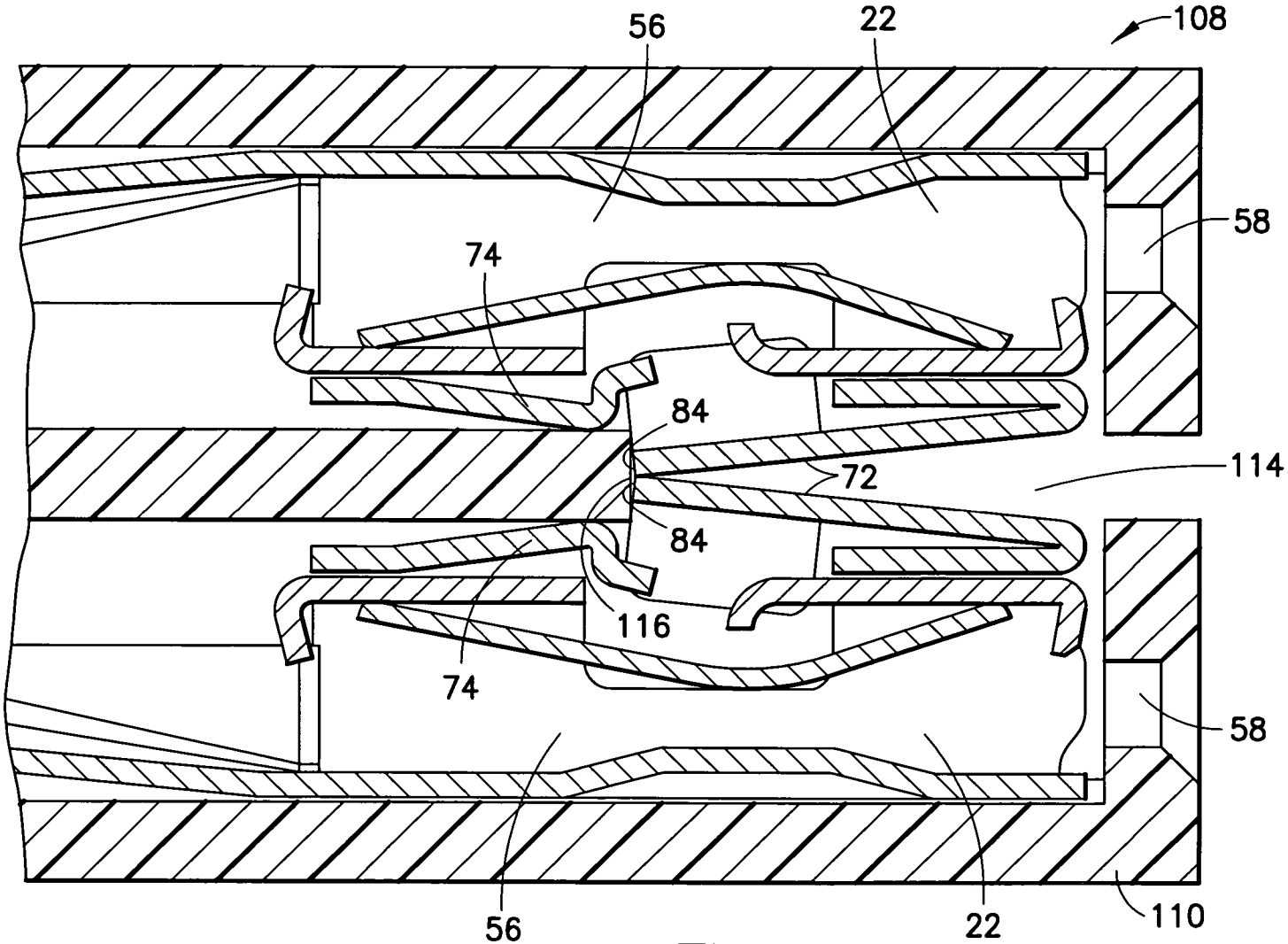
FIG. 9 is a cross sectional view similar to FIG. 7 showing two of the contact terminals mounted in an alternate housing of an electrical connector.
Figure 10:
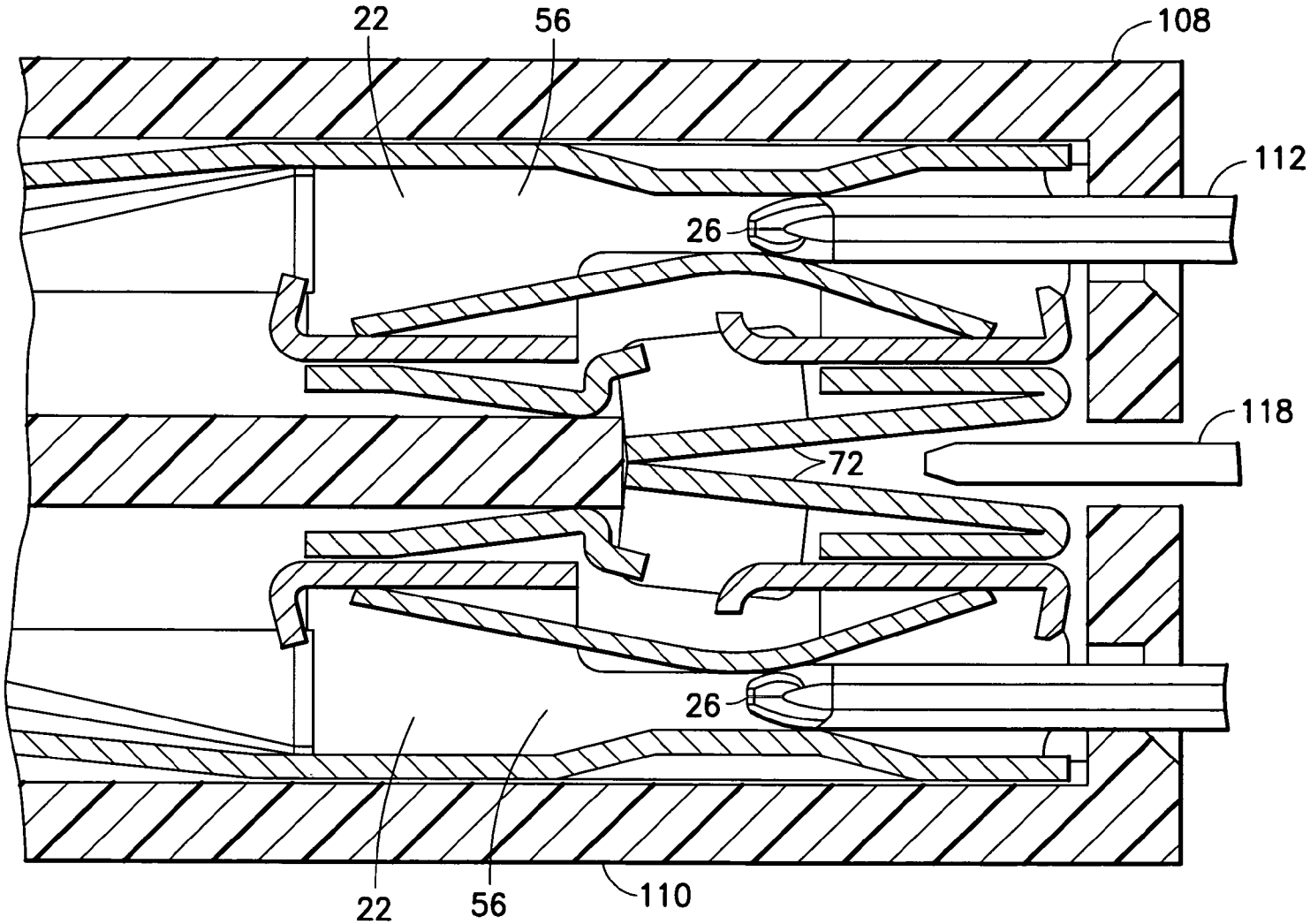
FIG. 10 is a cross sectional view as in FIG. 9 showing partial connection of the electrical connector to a mating electrical connector.
Figure 11:
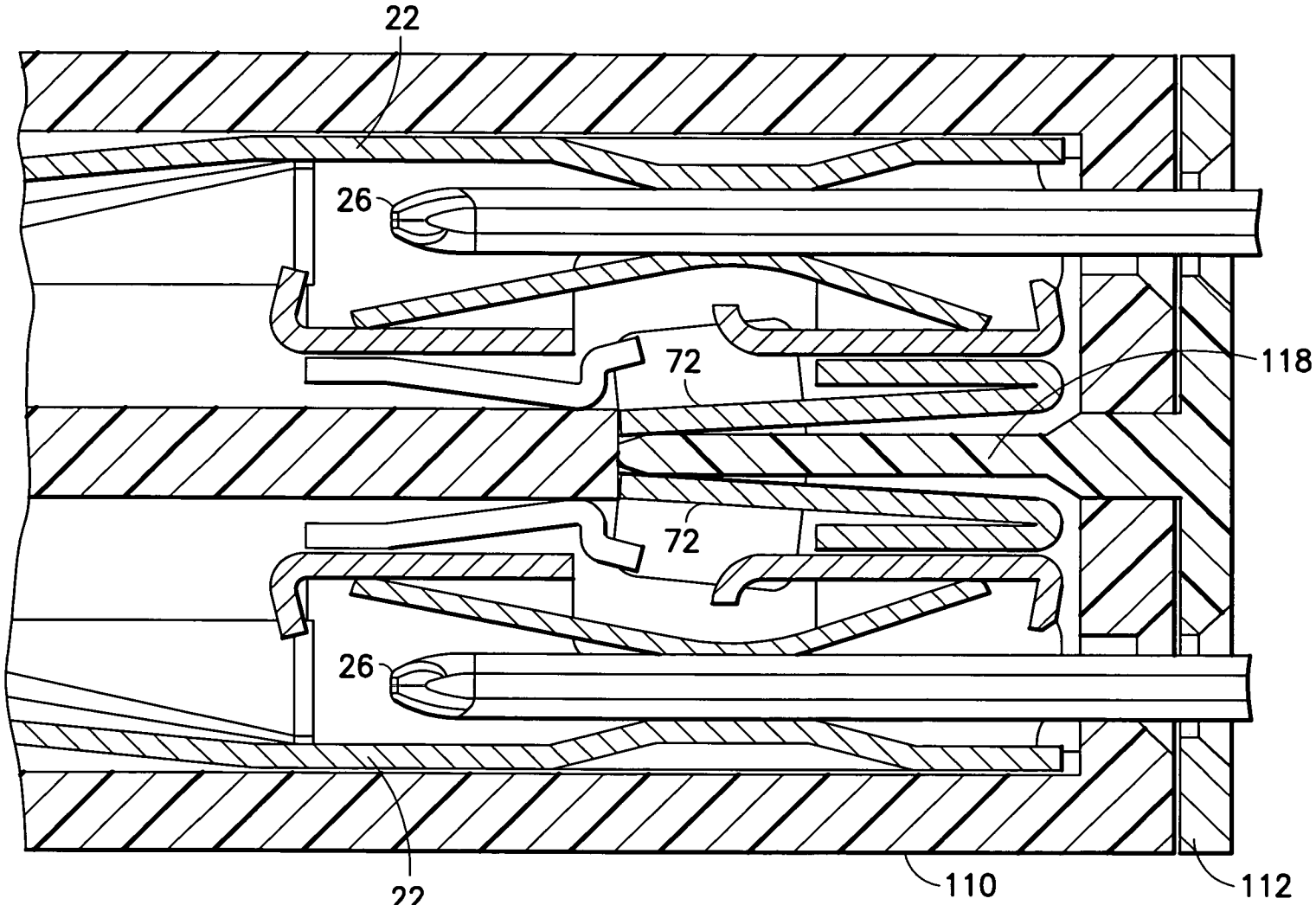
FIG. 11 is a cross sectional view as in FIG. 10 showing full connection of the electrical connector to the mating electrical connector.

Referring also to FIGS. 9-11, two of the electrical contact terminals 22 are shown connected to an alternate housing 110 to form an electrical connector 108. FIG. 9 shows the electrical connector 108 before connection to a mating electrical connector 112. The housing 110 comprises contact receiving areas 56. The electrical contacts 22 are located in the contact receiving areas 56. The front end of the housing 110 comprises apertures 58 into the contact receiving areas 56. The apertures 58 are adapted to allow insertion of the male contacts 26 into the contact receiving areas 56 and into mating electrical connection with the electrical contacts 22.

As shown in FIG. 9, the housing 110 has a snap-lock recess 114 which is open to two of the contact receiving areas 56. When the terminals 22 are inserted into the receiving areas 56 and reach their fully inserted positions, the latches 72 can deflect back to their outward positions. This results in the surface 84 of both latches being located in the recess 114 in front of the latching surface or shelf 116. The primary lock provided by the latch 72 snaps over the shelf in the connector cavity, thus, providing retention while the snag-resistant feature 74 remains deflected. The surfaces 84, 116 cooperate to prevent unintentional withdrawal of the terminals 22 from the receiving areas 56. The anti-snag feature 74 can remain deflected inward at the fully inserted position.

The recess 114 and latches 72 are sized and shaped to allow the latches 72 to directly contact each other. This electrically connects the two terminals 22 to each other before connection of the electrical connector 108 to the mating electrical connector 112. Thus, the latches 72 each form a combined housing latch and shorting member. As seen in FIGS. 10 and 11, when the mating electrical connector 112 is connected to the electrical connector 108, a portion 118 of the housing of the mating electrical connector 112 is inserted between the two latches 72 and deflects the latches 72 apart. Thus, when the mating electrical connector 112 is connected to the electrical connector 108, the shorting contact provided by the latches 72 is automatically disconnected.

Referring also to FIGS. 12-15, an alternate embodiment of an electrical contact terminal 120 is shown temporarily connected to a carry strip 124. The terminal is similar to the terminal 22. The terminal 120 comprises a female contact section adapted to receive the male contacts 26 of the second electrical connector 18, 112. The terminal 120 is a two-piece terminal comprising a first piece 126 and a second piece 128. The electrical terminal 120 generally comprises a conductor connection section 68, a mating terminal connection section 122, a latch 72 and an anti-snag feature 74. The first piece 126 comprises the conductor connection section 68 and the mating terminal connection section 122. The second piece 128 comprises the latch 72 and the anti-snag feature 74.

The conductor connection section 68 is for connecting the terminal 120 to one of the wires 13. The mating terminal connection section 122 forms part of the female connection section which is adapted to receive one of the contacts 26 of the mating connector 18, 112. In this embodiment, as seen best in FIGS. 14 and 15, the mating terminal connection section 122 has top and bottom inwardly projecting connecting arms 130 which connect to a front section 132, and two rearward extending, cantilevered lateral side contact arms 134. The second piece 128 fits over the mating terminal connection section 122 and is crimped onto the mating terminal connection section 122 by crimped connection 136 at the rear of the second section 128. In alternate embodiments, any suitable type of connection of the two pieces to each other could be provided. Alternatively, the contact terminal could be a one-piece member, or comprise more than two members. In one type of embodiment, the two pieces 126, 128 could be comprised of different materials. In the embodiment shown the front of the second piece 128 has forward, inward projecting guides 138. The guides 138 help guide the male contact 26 into the receiving area formed by the arms 130, 134. The guides 138 could also interact with the housing to center the contact terminal relative to the apertures 58.

Figure 12:
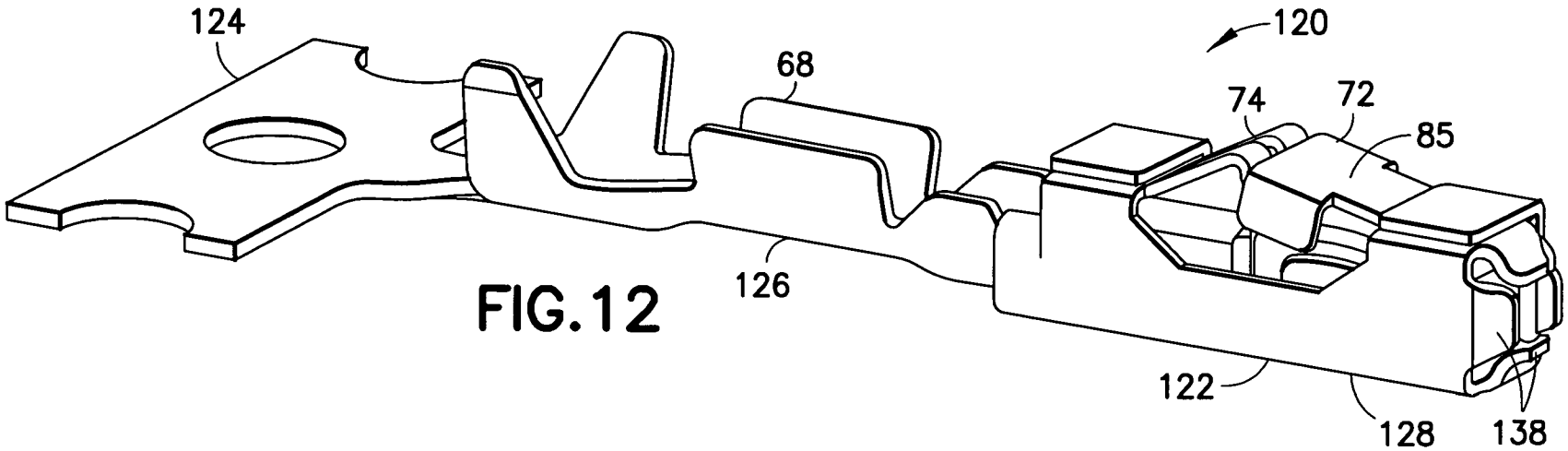
FIG. 12 is a perspective view of an alternate embodiment of a contact terminal incorporating features of the invention.
Figure 13:
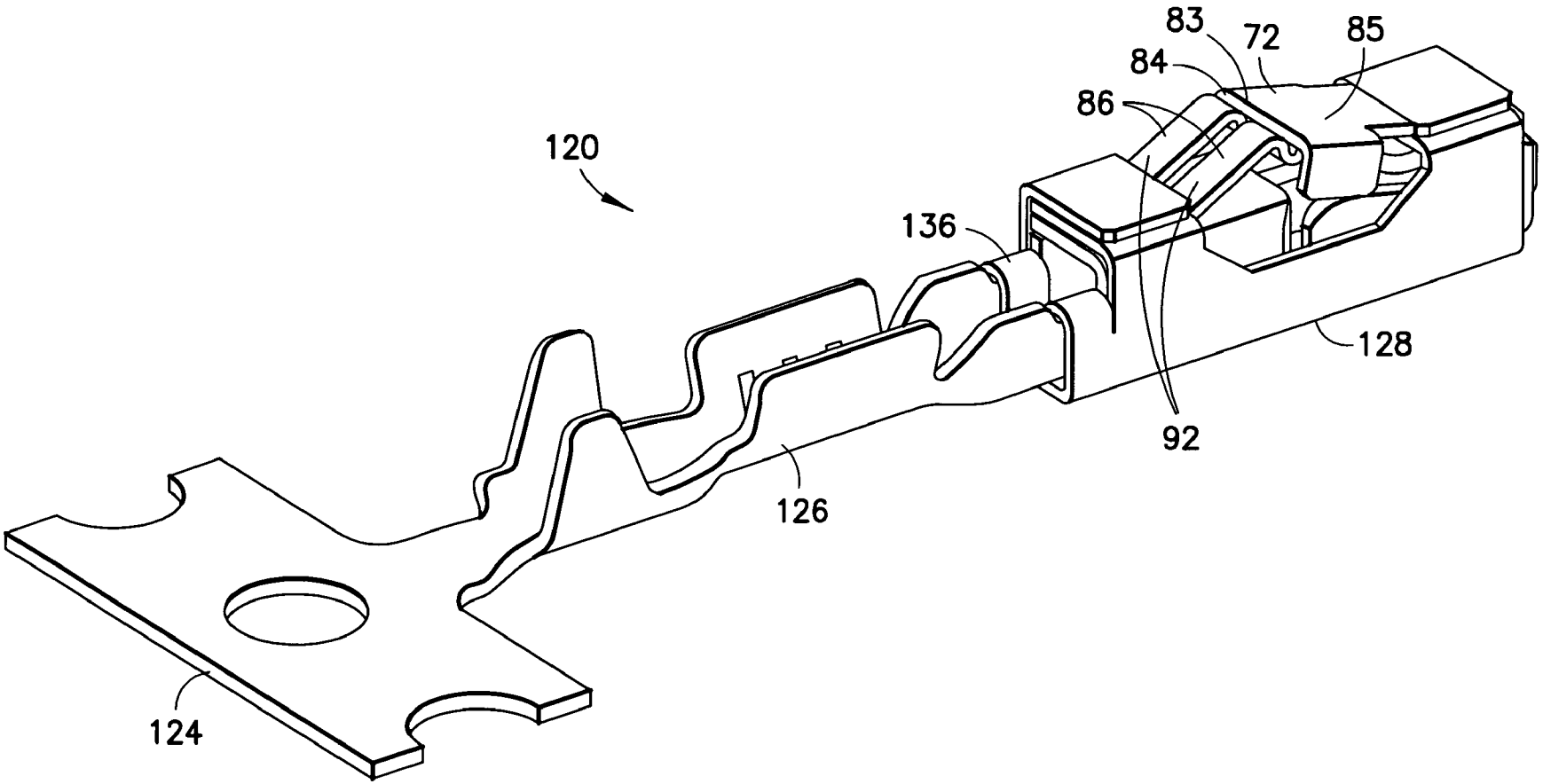
FIG. 13 is a perspective view of the contact terminal shown in FIG. 12 from another direction.
Figure 14:
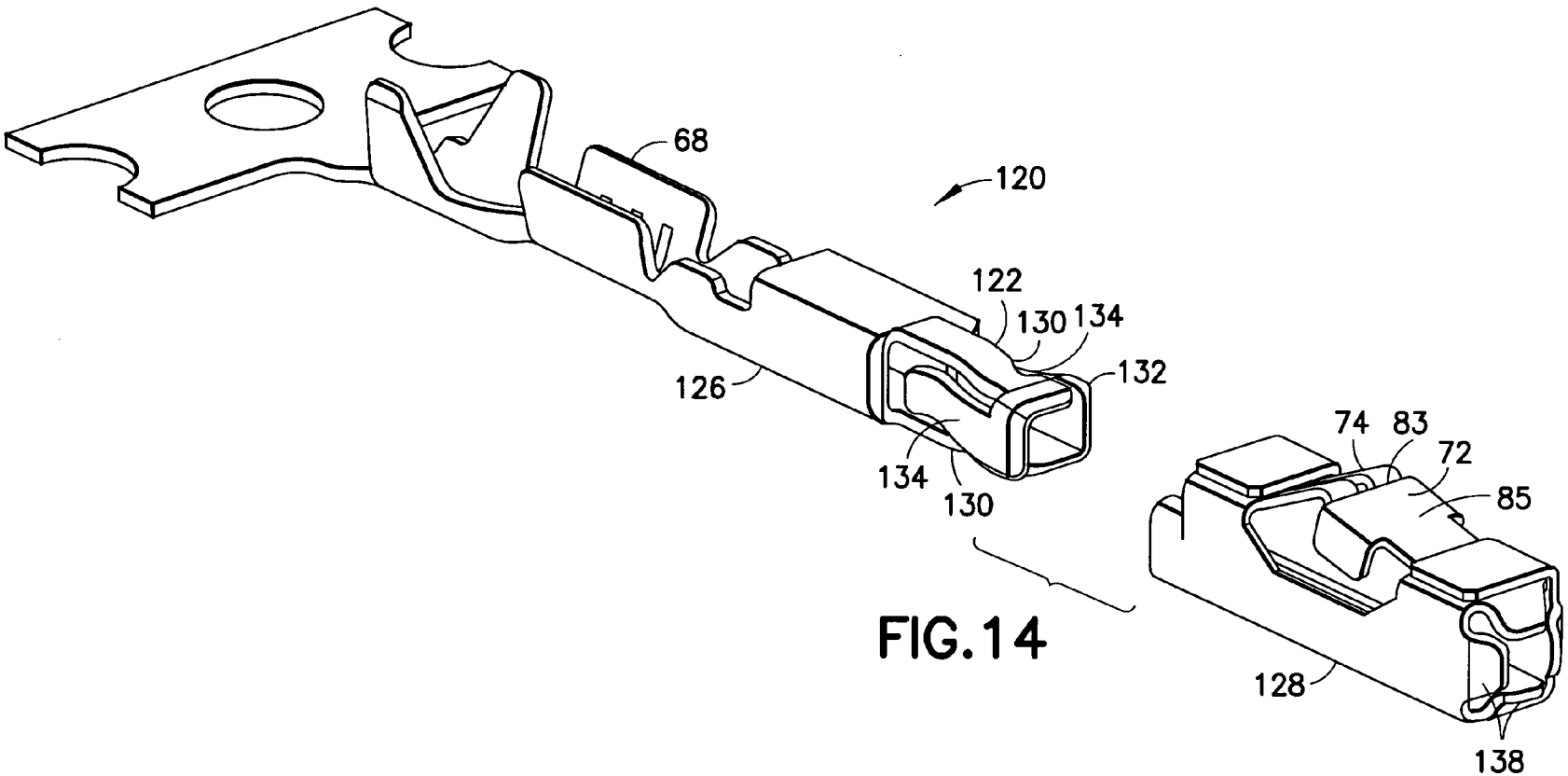
FIG. 14 is an exploded perspective view of the contact terminal shown in FIGS. 12-13.
Figure 15:
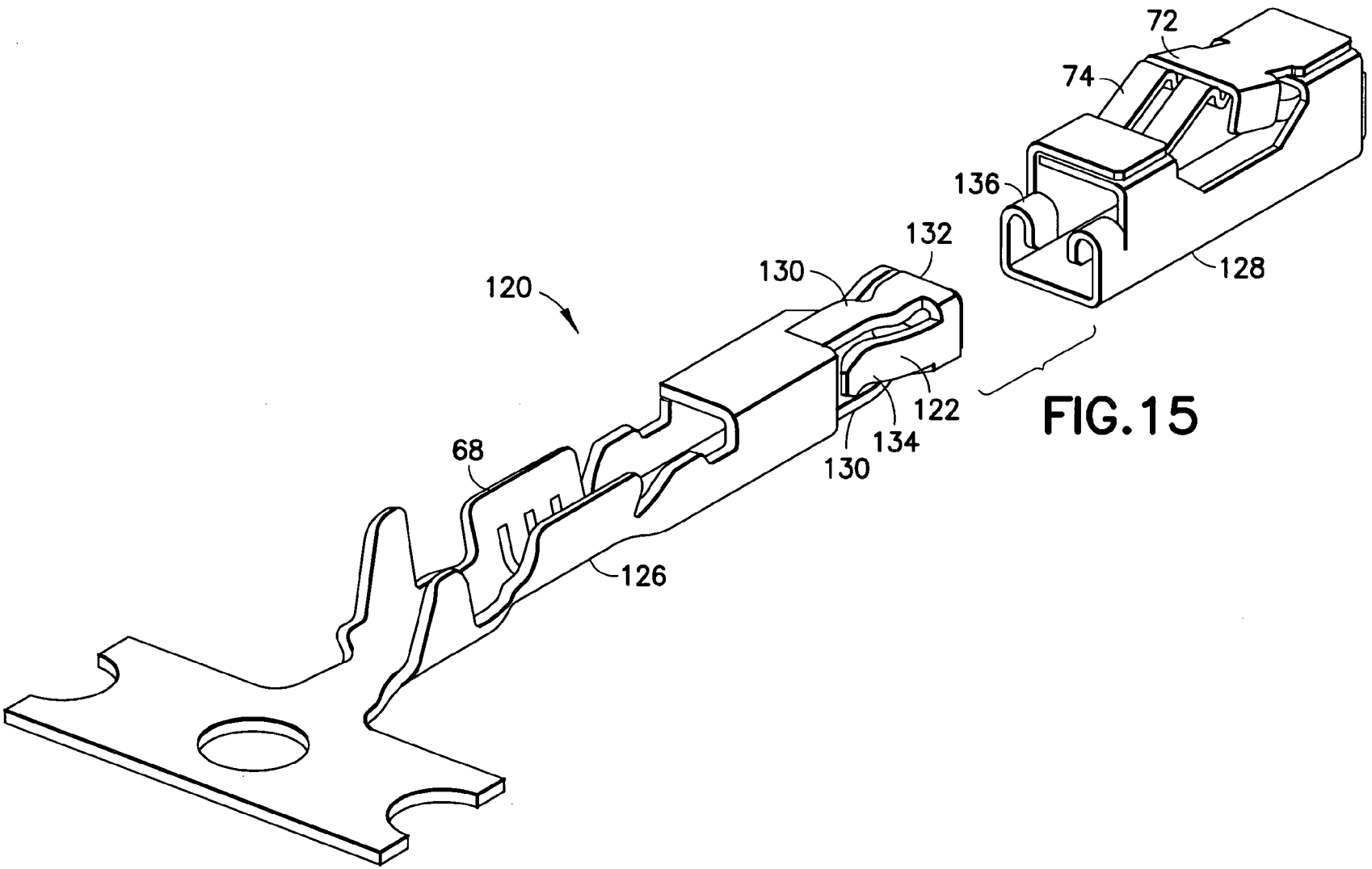
FIG. 15 is an exploded perspective view of the contact terminal shown in FIG. 14 from another direction.

As seen in FIGS. 12 and 13, the latch 72 is a flexible primary lock for latching the terminal 120 with the housing 20 or 110 inside one of the contact receiving areas 56. The latch 72 extends rearward from the front end of the second piece 128 as a general resiliently deflectable cantilevered arm. The end 83 of the arm forms a latching surface 84 to snap-lock latch with a portion 98 or 116 of the housing 20 or 110. The top side of the latch 72 forms a forward facing ramp surface 85.

The anti-snag feature 74 comprises two resiliently deflectable cantilevered arms 86 which extend forward from a rear end of the second piece 128. The front end of the arms 86 have pocket areas which receive the end 83 of the latch 72. Distal tips of the arms 86 are located beneath the end 83 of the latch 72. However, in an alternate embodiment the distal tip of the arms might not be provided beneath the latch 72.

A top side of the arms 86 extend above the top side of the surface 84 when the arms 86 are not deflected. Alternatively, the top sides of the arms 86 could be at the same height as the top of the surface 84 when the arms 86 are not deflected. The top sides of the arms 86 form rearward facing ramp surfaces 92.

When the terminal 120 is inserted into the housing, 20 or 112 for example, the housing causes the latch 72 to deflect inward. The anti-snag feature 74 is also deflected inward; first by contact with the end 83 of the latch 72 and then by direct contact with the housing. With further insertion of the terminal 120 into the housing, the terminal reaches its fully inserted position inside the receiving area 56 and the latch 72 can deflect back to its outward position. This results in the surface 84 being located in front of the latching surface or shelf 98 or 116. The primary lock provided by the latch 72 snaps over the shelf in the connector cavity, thus, providing retention while the snag-resistant feature remains deflected. The two surfaces 84, 98 or 116 cooperate to prevent unintentional withdrawal of the terminal from the receiving area 56 reverse to the direction of insertion. The anti-snag feature 74 can remain deflected inward at the fully inserted position. Thus, the anti-snag feature does not interfere with the operation of the latch 72.

Similar to that shown in FIG. 8, the terminal 120 can be removed from the housing 20 or 110 with the aid of the servicing tool 100. The tool 100 can be inserted through the front of the housing into the recess 96. The front of the tool 100 contacts the ramp surface 85 of the latch 72 and deflects the latch inward. This moves the latch surfaces 84, 98 or 116 apart to allow the terminal 120 to be pulled rearward and out of the housing. As the terminal 120 is pulled rearward, the ramp surface 92 on the arms 86 can resiliently deform the seal 50 and prevent the latching surface 84 from snagging on the seal 50. This prevents the latching surface 84 from cutting or tearing the seal 50 as the terminal 120 is being withdrawn through the seal 50.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing comprising at least two contact receiving areas;

at least two contact terminals connected to the housing in the contact receiving areas, wherein a first one of the contact terminals comprises a combined housing latch and shorting member, wherein the combined housing latch and shorting member is latched behind a portion of the housing to retain the first contact terminal to the housing, wherein the combined housing latch and shorting member directly electrically contacts a second one of the contact terminals, and wherein the combined housing latch and shorting member is resiliently deflectable and adapted to be moved by a portion of a mating electrical connector to electrically disconnect from the second contact terminal and still be retained latched behind the portion of the housing.

2. An electrical connector as in claim 1 wherein the portion of the housing is adjacent two of the contact receiving areas.

3. An electrical connector as in claim 1 wherein the second contact terminal comprises a combined housing latch and shorting member, and wherein the two combined housing latch and shorting members contact each other.

4. An electrical connector as in claim 3 wherein the housing is adapted to allow the portion of the mating electrical connector to wedge between the two combined housing latch and shorting members.

5. An electrical connector as in claim 1 wherein the first contact terminal comprises a deflectable anti-snag ramp located directly behind a latching edge of the combined housing latch and shorting member when the deflectable anti-snag ramp is not deflected by the electrical connector housing.

6. An electrical connector as in claim 5 wherein the deflectable anti-snag ramp comprises a cantilevered arm extending forward on a mating terminal connection section of the first contact terminal.

7. An electrical connector as in claim 6 wherein a distal tip of the deflectable anti-snag ramp is located beneath the deflectable latch.

8. An electrical connector as in claim 6 wherein an end of the end of the deflectable anti-snag ramp has a pocket section.

9. An electrical connector as in claim 5 wherein the deflectable anti-snag ramp comprises two parallel beam sections.

10. An electrical connector as in claim 1 wherein the combined housing latch and shorting member comprises a cantilevered arm extending rearward from a front end of a mating terminal connection section.

11. An electrical connector as in claim 1 wherein at least one of the contact terminals is a two-piece terminal comprising a first piece forming a conductor connection section and a mating terminal connection section, and a second piece connected over the mating terminal connection section comprising the combined housing latch and shorting member and a deflectable anti-snag ramp.

12. An electrical terminal comprising:

a conductor connection section;

a mating terminal connection section connected to the conductor connection section, wherein the mating terminal connection section comprises deflectable contact arms forming a female receiving area;

a deflectable latch proximate the mating terminal connection section, wherein the latch is adapted to latch with an electrical connector housing when the terminal is fully inserted into the electrical connector housing; and a deflectable anti-snag ramp located generally behind the deflectable latch, wherein the electrical terminal is a two-piece terminal comprising a first piece forming the conductor connection section and the mating terminal connection section, and a second piece connected over the mating terminal connection section comprising the deflectable latch and the deflectable anti-snag ramp.

13. An electrical terminal as in claim 12 wherein the deflectable latch is adapted to directly electrically contact a deflectable latch of another electrical terminal when inserted into an electrical connector housing to electrically connect the two electrical terminals to each other, and be deflectably moved out of electrical contact with each other by a portion of a mating electrical connector.

14. An electrical terminal as in claim 12 wherein the deflectable anti-snag ramp is located directly behind a latching edge of the deflectable latch when the deflectable anti-snag ramp is not deflected by the electrical connector housing.

15. An electrical terminal as in claim 12 wherein the deflectable latch comprises a cantilevered arm extending rearward from a front end of the mating terminal connection section.

16. An electrical terminal as in claim 12 wherein the deflectable anti-snag ramp comprises a cantilevered arm extending forward on the mating terminal connection section.

17. An electrical terminal as in claim 16 wherein a distal tip of the deflectable anti-snag ramp is located beneath the deflectable latch.

18. An electrical terminal as in claim 16 wherein an end of the deflectable anti-snag ramp has a pocket section.

19. An electrical terminal as in claim 12 wherein the deflectable anti-snag ramp comprises two parallel beam sections.

20. A method of forming an electrical contact terminal comprising:

forming a conductor connection section;

forming a mating terminal connection section connected to the conductor connection section, wherein the mating terminal connection section comprises deflectable contact arms forming a female receiving area;

forming a deflectable latch proximate the mating terminal connection section; and forming a deflectable anti-snag ramp located generally behind the deflectable latch, wherein the electrical contact terminal is a two-piece terminal comprising a first piece forming the conductor connection section and the mating terminal connection section, and a second piece connected to the first piece over the mating terminal connection section, wherein the second piece comprises the deflectable latch and the deflectable anti-snag ramp.

* * * * *